United States Patent [19]

Hennings

[11] Patent Number: 4,910,934

[45] Date of Patent: Mar. 27, 1990

[54] BLIND CONSTRUCTION LOCK AND METHOD OF UTILIZATION OF THE LOCK IN BUILDING CONSTRUCTION

[76] Inventor: Carl W. Hennings, 35 C. Buffalo La., Yerington, Nev. 89447

[21] Appl. No.: 264,013

[22] Filed: Oct. 28, 1988

[51] Int. Cl.[4] ..... E04B 1/41

[52] U.S. Cl. ..... 52/293; 52/210; 52/241; 52/295; 52/480; 52/714; 52/715; 52/376; 52/DIG. 8

[58] Field of Search ..... 52/367, 715, 714, 295, 52/370, 712, DIG. 6, 214, 211, 215, 216, 376, 371, 238, 241, 684, 480, 741, 210

[56] References Cited

U.S. PATENT DOCUMENTS

| | | | |
|---|---|---|---|
| 1,631,502 | 6/1927 | Pawling | 52/370 |
| 1,767,575 | 6/1930 | Bujack | 52/370 |
| 1,792,725 | 2/1931 | Baum | 52/376 |
| 1,998,688 | 4/1935 | Robinson | 52/241 |
| 2,110,863 | 3/1938 | Barnett | 52/295 |
| 3,397,502 | 8/1968 | Simpson | 52/376 |
| 3,753,328 | 8/1973 | Papsco | 52/241 |

FOREIGN PATENT DOCUMENTS

| | | | |
|---|---|---|---|
| 425624 | 3/1935 | United Kingdom | 52/714 |

*Primary Examiner*—John E. Murtagh
*Attorney, Agent, or Firm*—Richard C. Litman

[57] ABSTRACT

A unitary blind locking device for prefabricated structure construction configured into a substantially rectangular shape for securely binding together pairs of suitable similar and/or dissimilar construction materials of similar and/or dissimilar thicknesses. It has a plurality of legs with end parts that are to be used for gripping the construction parts firmly together by means of the cleats or teeth punched out of an interfitting plate that is part of the lock itself and, for anchoring purposes, said lock being fabricated in various shapes and sizes and with accompanying wall lifting straps to meet the demands of workmen at the permanent construction site so as not to hamper their vision while erecting the permanent structure and also to allow the construction at the prefabrication site to proceed smoothly.

14 Claims, 10 Drawing Sheets

BLIND CONSTRUCTION LOCK AND METHOD OF UTILIZATION OF THE LOCK IN BUILDING CONSTRUCTION

FIELD OF THE INVENTION

The field of the present invention is concerned with preassembled or prefabricated walls made of wood or other suitable materials for housing or commercial utility buildings of all types wherein the walls can be conveniently constructed in a factory or shop by using various fastening means to bind or securely fit together the various discrete construction components "blind", that is, so that the walls can be built in a yard or in a plant, instead of stick-built, and nailed together on the job site, which was and still is the customary practice. An increased economy of operation results by avoiding inclement weather and duplication of the labor efforts that adds to cost of construction and which slows down the construction process.

BACKGROUND OF THE INVENTION

The present invention consists of different sized and shaped blind locks, binders, or clamps, being constructed of metal, reinforced plastics, Fiberglas or other suitable construction material, for the locking or binding two discrete construction component parts together for the purpose of prefabrication or pre-assembly, the assembly being accomplished "Blind" in the erection process, the clamps locking the opposing assemblies completely blind inasmuch as the exterior siding and interior finish already being installed, the finished components being assembled in the field at the job site. This same lock is adaptable or can be easily made adaptable to any and all construction paraphernalia such as fire walls, corners, exterior and interior walls, sills, joist hangers, lock-to plates, and the like. Each blind lock, binder, or clamp, securely locks two construction members together, without using nails, screws or glue as in conventional construction, thus allowing the construction components, which are oftimes discrete, to be manufactured in a factory or shop and later erected with ease, with the aid of a light crane, at the construction site as convenient. The size of the present blind locks can be varied to fit any size of construction materials used whether they be 2"×4", 4"×4", 1"×4" or virtually all sizes and combinations of construction materials used in the prefabrication art.

The blind lock of the present invention allows the manufacturer to assemble all components in a factory, assembly line or yard and the walls may be built on an assembly line, complete with the exterior siding, insulation, electrical system, plumbing, windows, doors and interior paneling or sheetrock all in place, with the exceptions of the exterior corner trim and the interior corner trim and base molding.

Thus the construction walls are bound, or locked, together "blind", that is, away from the permanent site of the house or building (i.e., the interior finish and the exterior finish can both be applied previous to assembly of the adjoining or intersecting walls so long as they are not permanently attached within 16 inches of one of the framing members) so as to enable them to be built in a yard or a plant, instead of "stick-built" and nailed together on the job site, which was and still is the customary practice.

The present lock will start gripping at a dimension of 1½ inches thickness of lumber (or other suitable construction material) to compensate for different dimensions in normal lumberyard surfaced lumber which varies from 1½ to 1⅝ inches thickness. If this compensation is not made, a looseness around the teeth in the lock will develop after an earthquake or severe high winds. By springing to the 1⅝ inch dimension, the lock will compensate for this difference in thickness in commercial lumberyard surfaced lumber and, regardless of the dimension, will maintain a constant pressure under all conditions. Under severe stress this pressure becomes even greater in its gripping power; and yet at the time of erection, the blind lock, clamp, or binder, will easily spring into a clamped position and maintain that position at all times, albeit with greater pressure for a firmer grip and thus even greater safety under the severe strain of an earthquake or high winds. When sheet metal is used, depending on the gauge of the sheet metal it will surpass all building construction safety standards (12 gauge, approximately one hundred twenty-five thousandths inch thickness) of ASTM-A galvanized mild steel.

When 16–18 gauge galvanized steel is used in the construction of the present locking device, slight differences in the gauge of the material are used, depending only on the design of the lock, in determining the actual gauge to be chosen by the workman.

Major components of the invention include an inner partition lock, a concrete sill anchor, a concrete sill anchor corner retainer, a subfloor sill anchor, an exterior/interior partition corner stud lock, a stud lock itself, a top plate lock, a mudsill anchor and wall spreader, and a continuous lock with sheetrock return.

PRIOR ART

U.S. Pat. No. 3,872,633 issued Mar. 25, 1975 to Altosaar et al discloses a partition mounting device comprising a floor or ceiling runner and discrete L-shaped locking members to form a base of a partition. The completed partition and discrete locking means (flanges) are then snapped into position to hold the panel. Only decoupling tools are required to remove the locking members.

U.S. Pat. No. 3,133,322 issued May 19, 1964 to Douglas discloses wall panels for prefabricated buildings and coupling joints and the anchoring means therefor which may include battens, masking battens, wedges, elastic strip battens, grooves, bolts and the like.

U.S. Pat. No. 4,527,364 issued July 9, 1985 to Baus discloses a corner assembly of structural members comprising a system of pre-formed openings and locking bolts to secure the structural members and the connector member together to form a corner assembly. It is used primarily in the field of furniture, particularly for mirrored wardrobes and employs wedges to hid the bolts and to protect the aesthetic beauty of the wardrobe by covering up and hiding the bolts.

U.S. Pat. No. 4,201,020 issued May 6, 1980 to Saunders merely discloses other examples of prefabricated building joints and anchoring means, such as nail plates and interfitting beam segments, as does U.S. Pat. No. 4,272,930 issued June 16, 1981 to Foster, which uses removable serrated wedges for locking together with pins, plates, sleeves, studs and the like.

All of the above-described prior art patents use methods very dissimilar to the present invention. The applicant's invention uses metal alloy members for locking, binding, clamping, fastening or anchoring members and the like designed to fit the varied shapes of construction materials used in the prefabricated construction. These prior art patents use bolts, screws, and the like which are designed to go through a hole (usually pre-drilled) in the construction member(s) and do not contemplate the entirely different approach of the present invention which completely encloses the construction member and locks it into position, similar to nailing it, except that it does not go through the construction member but around it to retain it in a permanent position.

This approach is entirely different from the patent to Altosaar which uses a lock seam assembly, and runners with ridges, or from the Douglas patent which uses a system primarily of battens, or from the patent to Foster whose chief locking mechanism is a serrated wedge.

SUMMARY AND OBJECTS OF THE INVENTION

The above-mentioned invention relates to a method of connecting two construction wall members securely (and with ease of effort for the workmen) together "blind" (as mentioned above) without using nails, screws or glue as in conventional construction, so that each wall may be made as a component in a factory, shop, yard or the like and erected into a unit in the field and assembled at the current construction site with the aid of a crane, as needed.

The primary object of the present invention is to provide a device to supply the building and construction industry with a much easier to use, and economical fastening system, which will revolutionize the building industry. The major changes will take place in the modular and prefabricated construction arena; however, there are also numerous applications in the commercial and industrial construction industry.

Another object of the device of the invention is to drastically cut production costs in the modular and prefabrication field of construction by reducing substantially the number of workmen necessary to construct any and all houses or buildings of this field, along with the necessary savings in construction costs by the advantages of construction in this field in general, as broad as they may be, yet further enhancing the advantages of cost-cutting in the field as a whole.

Another object of this device is to accomplish its purpose of joining two construction members together by clamping; the device is unique in that it allows the wall or component to be built complete and continuously with exterior siding, insulation, electrical wiring, rough plumbing, and interior finish to be installed and the finished wall complete and fulfills the need to cut production costs in the construction industry. In regard to production costs, there is very little expense incurred in adapting any assembly system now in use to the system of the present invention, yet the cost savings obtained by the use of the blind locks of the present invention would be substantial.

Yet another object of the device of the invention is to prevent slippage or sliding of any two joined construction members (and thus the safety and security of the whole unit being constructed) which are joined by the said devices of this invention in order to protect against said sliding or shifting which may be caused by earthquakes or high winds or man-made outside pressures from whatever source.

A still further object of the device is to meet all the Uniform Building Code (UBC) safety requirements and likewise the safety requirements of the ICBO in the construction building trade regarding to stress and strength requirements.

The present blind locks (binders, or fasteners) also may be applied, if desired, to items such as an electrical outlet box. Their proper applications are to quick-lock the two aforesaid discrete construction components and to fasten the inner or outer walls either to concrete or to a floor joist system, as the case may be, or to fasten a wall to a wall or a corner, or such like operations.

The lock of the present invention is intended for use in the construction of modular homes, prefabricated homes, mobile homes, travel trailers, campers, condominiums and apartments, and housing of all types such as commercial buildings and industrial construction.

With these and other objects in view which will more readily appear as the nature of the invention is better understood, the present invention resides in the novel construction, combination and assembly hereinafter more fully illustrated, described and claimed, with reference being made to the accompanying drawings wherein the same reference characters are applied to the same or corresponding parts in the various illustrations.

DETAILED DESCRIPTION OF PREFERRED EMBODIMENT

Figure 1:
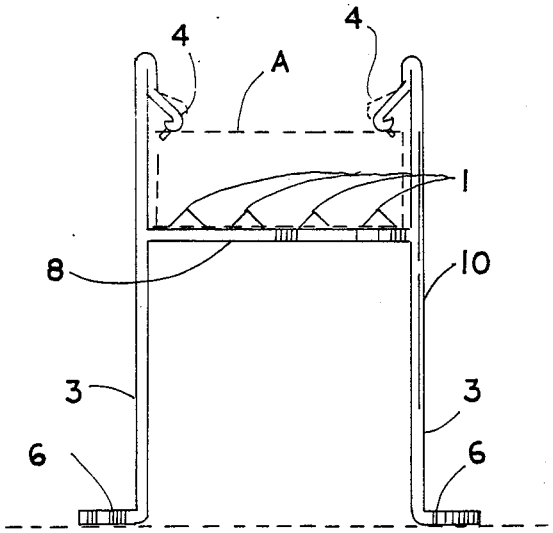
FIG. 1 is a front elevational view of the inner partition lock of the present invention.

Attention is directed to the fact that all the drawings of the blind locks (binders or fasteners) referred to hereinbelow show that all blind locking or clamping features herein described, in such figures (FIGS. 1, 4, 10, 14, 19, 23, 27, and 30) wherein the locking, or gripping detail is shown in the top or bottom end parts of the blind locks of the present invention, is accompanied by the detail showing the alternate position variation of substantially 15 degrees (from 45 degrees to 30 degrees, reflected by broken lines) in order to allow for different sizes (1½ inches to 1⅝ inches) in thickness in lumberyard lumber most commonly available to the workmen using these locks. This singular feature was designed to compensate for the slight differences in size, although the blind locks of the present invention will, as mentioned before, lock together substantially all different or like-sized construction components used in the construction prefabrication art aforementioned.

The present blind lock is used to lock, clamp, fasten, or bind two similar or discrete construction components in prefabrication housing or commercial utility building construction to prevent obstruction of the view, or blinding, of the worker at the permanent job site in order that the worker may thereby be enabled to work on exterior walls lastly during his construction endeavors at said permanent job site and thus not allow impeding of his view due to the presence of the outer walls during the affixation process of these two similar or discrete construction components, and also to ensure that the construction walls are allowed to be bound, or locked together blind, that is, away from the permanent site of said prefabricated housing or commercial utility building so as to enable this particular house or commercial utility building to be prefabricated in a factory, yard or plant instead of being stick-built and nailed together on the permanent job site. The present invention may use galvanized sheet steel, reinforced plastics, Fiberglas or other suitable construction material to construct the blind lock herein described for the purpose substantially of locking or binding construction walls together in order that the completed permanent structure may meet current stress and strength construction safety standards.

The blind lock is adaptable to securely lock, clamp, fasten or bind together either 1½ inch or 1⅝ inch thicknesses of lumberyard lumber commonly available for construction of this kind, or other of suitable similar or discrete construction components to be used by the worker/carpenter. This blind lock maintains a constant pressure under all stress conditions during the construction process at either the prefabrication site or the permanent job site regardless of the dimensions of either 1½ inch or 1⅝ inch thicknesses of the lumberyard lumber or other suitable construction components available. Under severe stress the constant pressure enhances the gripping power but, at the time of erection, the blind lock easily springs into a clamped or locked position.

Also, this blind lock may be easily made adaptable to substantially any construction paraphernalia such as fire walls, corners, exterior and interior walls, sills, joist hangers, lock-to plates and the like to bind any two similar or discrete construction components together in the technology of prefabrication housing/commercial utility building construction.

Figure 2:
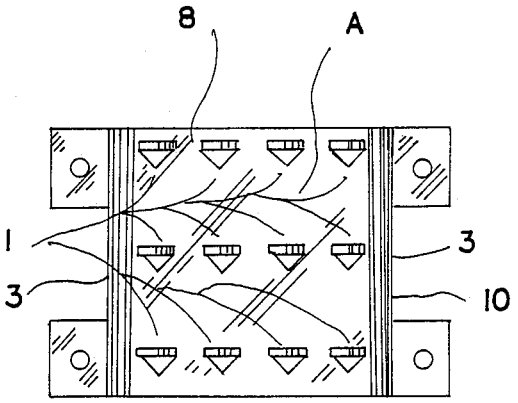
FIG. 2 is a top plan view of the same lock.
Figure 3:
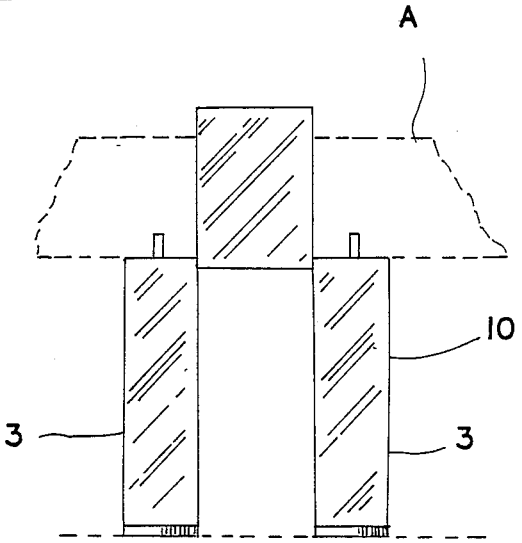
FIG. 3 is a side elevational view of the same lock.

In order to fully explain and demonstrate the function of the devices of the present invention, an inner partition lock generally indicated at 10 is shown in FIGS. 1–3 from differing viewpoints. This particular lock is used to lock any intersecting partition walls together. It contains pierced cleats 1, or teeth in the shape of an isosceles triangle. FIG. 1 further illustrates the legs 3 of this particular lock with top protrusions 4 at an angle of 45 degrees (after locking, or gripping of the construction material A, with the bottom protrusions 6 at right angles for anchoring purposes).

Figure 27:
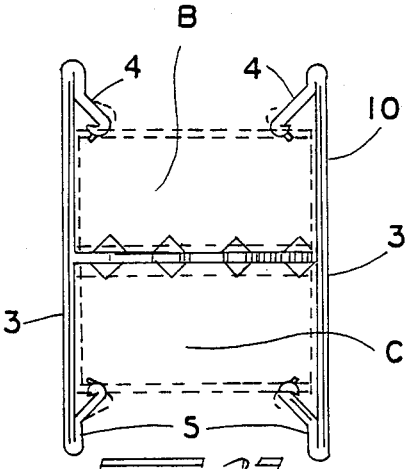
FIG. 27 is a front elevational view of the same lock.
Figure 28:
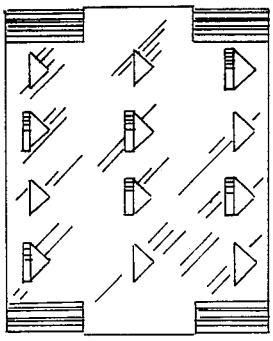
FIG. 28 is a bottom view of the same lock.

The same lock is represented in FIG. 2 for gripping the discrete construction member A to prevent slippage, sliding or horizontal shifting. FIG. 27 shows legs 3 of another embodiment of the blind lock (top plate lock) with top protrusions 4 and bottom protrusions 5 formed for gripping the similar component construction materials designated by B and C of this figure. FIGS. 1, 4, 10, 14, 19, 23, 29 and 30 all show this same gripping, fastening, or locking aspect in differing aspects.

Figure 12:
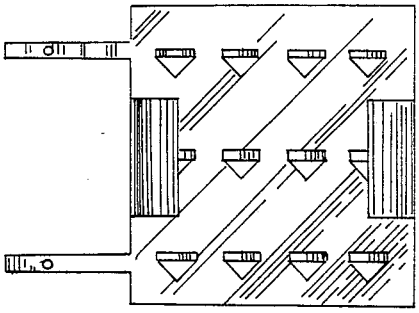
FIG. 12 is a top plan view of the same lock.

With respect to the interfitting relationship between the two similar or dissimilar construction members (as the case may be) in FIG. 1 is shown a front elevational view of the fitting/interfitting plate 8 (in this view, merely fitting) of the inner partition lock with cleats, or teeth 1 embedded into construction material A, and in FIGS. 2 and 12 the showing is of this same inner partition lock 8 complete with pierced stamped-out cleats 1 of the aforementioned isosceles triangular shape. FIG. 3 illustrates additional details of the inner partition lock in a side elevational view. This inner partition lock is used to lock any interior and exterior intersecting wall. Notice that by virtue of the unique design, the changes made to the conventional construction corner, thereby saving lumber costs.

Figure 4:
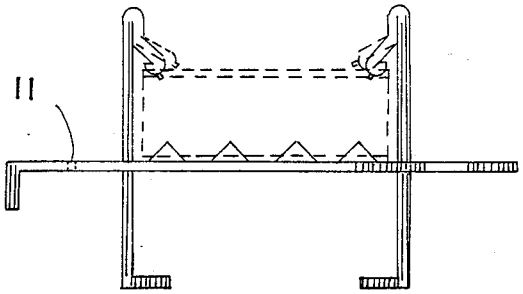
FIG. 4 is a front elevational view of the concrete sill anchor of the present invention.

A concrete sill anchor is shown in FIG. 4, with a hole 11 for insertion of a suitable nail or screw. This particular lock is used when a building is to be erected on a concrete floor and is designed to rest on top of the concrete/concrete exterior form. The lower half is embedded in concrete to act as an anchor for a wall sill, instead of bolts or power-driven nails or studs.

Figure 5:
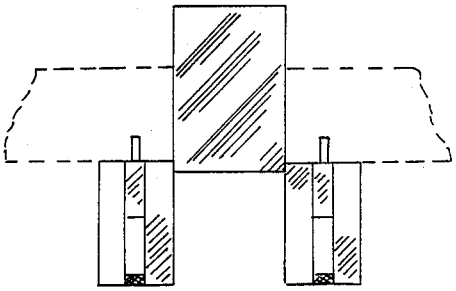
FIG. 5 is a side elevational view of the same lock.
Figure 6:
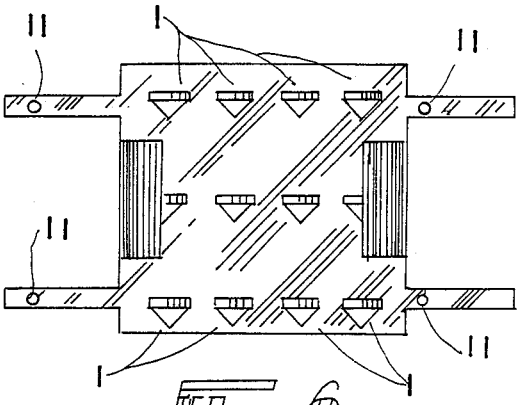
FIG. 6 is a top plan view of the same lock.
Figure 7:
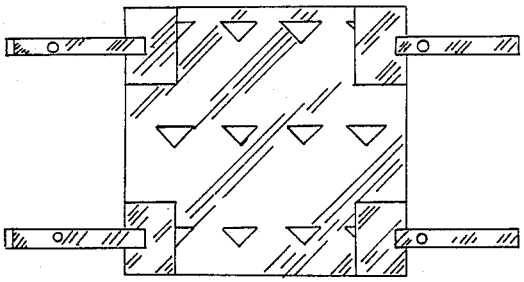
FIG. 7 is a bottom view of the same lock.

FIG. 6 shows holes 11 for nails, with FIGS. 5 and 7 being other views to help in visualizing the embodiment of this particular blind lock. This concrete sill anchor is used in the event a house, utility structure, commercial structure to be built at a permanent site by means of the blind lock(s) of this invention, including most, if not all, different types of structures hereinbefore mentioned (as it would not include mobile homes, campers and travel trailers, etc. with the concrete sill anchor).

Figure 8:
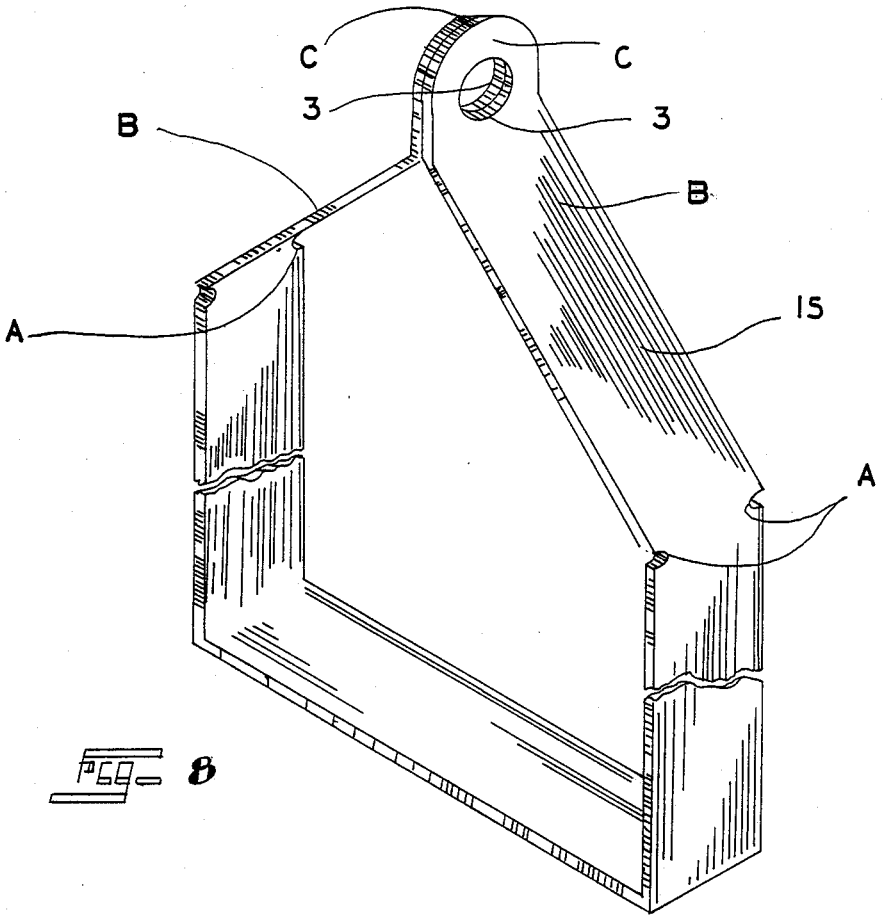
FIG. 8 is an isometric view of the wall lifting strap of the present invention.
Figure 9:
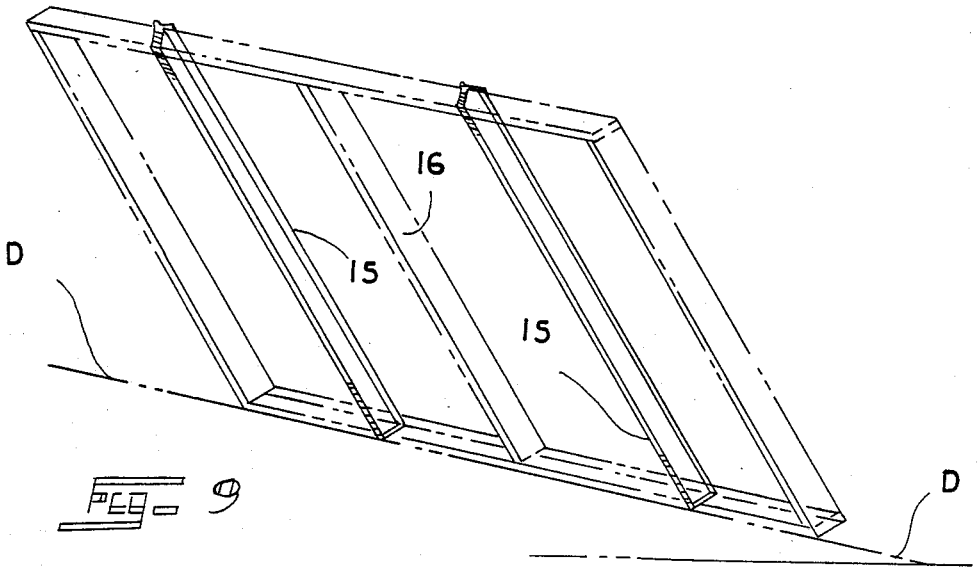
FIG. 9 is an oblique view of the wall lifting strap showing its application to the wall.

In order to fully demonstrate the use of the wall lifting strap of FIGS. 8 and 9, two differing views are shown. The wall lifting strap 15 depicted by FIG. 8 of the drawings is constructed of appropriate gauge metal or other suitable material and is used for wall erection purposes, two or more of these straps being shown at 15 in FIG. 9 and are placed along the wall at intervals and left in place, as they are designed to be broken off by flexing, so as not to interfere with the top plate (not shown). The wall lifting strap 15 of this particular version of the invention must go below the sill D. A spreader bar, or beam 16 is also used in the erection of the walls. The wall lifting strap 15 of FIG. 8 is of unitary construction fashioned in the shape substantially of a rectangle with crimping A and with top parts B formed at an angle of substantially 45 degrees to allow for tightening, and with topmost end parts C containing circular cutouts 3 for securing the end parts together by means of shackles and chokers (not shown) as safety dictates.

Figure 10:
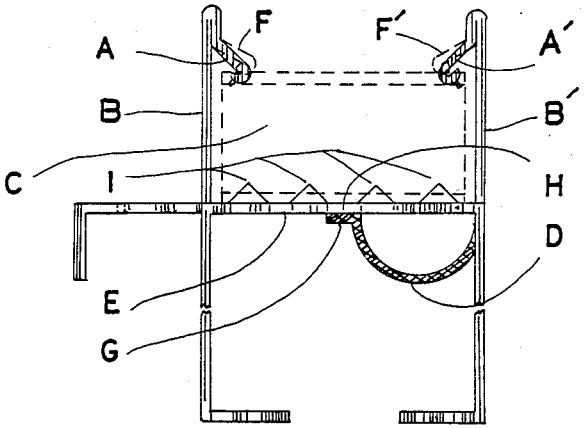
FIG. 10 is a front elevational view of the concrete sill anchor corner retainer of the present invention.

The concrete sill anchor corner retainer (shown in FIGS. 10–13 in differing views) is the same as the concrete sill anchor shown in FIGS. 4–7 except it is turned up on the end to retain the sill from sliding. Two of each hand are required (left and right). FIG. 10 shows in detail the 30-degree angle to be sprung to 45 degrees formed by the protrusions A and A' with legs B and B' in all the blind locks of the present invention wherein the locking, or gripping detail is shown in the end parts of the various devices and is accompanied by the details F and F' indicating the alternate position variation aspect of substantially 15 degrees (from 45 degrees to 30 degrees, reflected by broken lines) in order to allow for differing sizes in thicknesses of lumber. This detail is also shown again in each particular lock in differing views and embodiments in FIGS. 1, 4, 14, 19, 23, 27 and 30. It is not, however, shown in FIG. 29 although this figure is a blind lock also.

The purpose of this allowance of flexing or springing of all the blind locks is for a gripping, or grasping, or clamping effect to insure firm locking of the constructing material. Multi-stamped pierced cleats 1 on the interfitting center plate E in order to prevent constructing material C from shifting horizontally.

Figure 11:
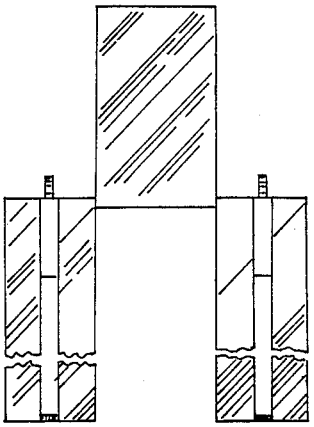
FIG. 11 is a side elevational view of the same lock.
Figure 13:
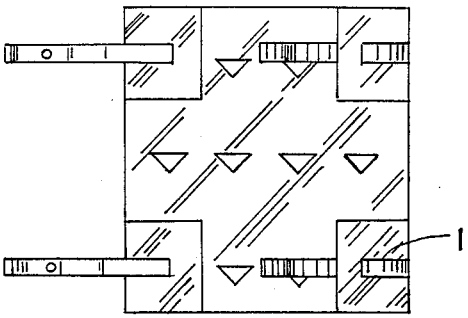
FIG. 13 is a bottom view of the same lock.

An illustration of the concrete sill anchor corner retainer is shown by FIG. 11 for better visualization, with FIG. 12 being a view of this lock with various visual details added as shown basically in FIG. 2. FIG. 13 is a bottom view of this same lock of the instant blind lock with the tang 1 that is notched out.

By using the sill anchor (concrete or subfloor) shown in FIGS. 4–7 and 14–16 respectively, the foundation or anchor bolts (not shown) are eliminated, however these are fitted or placed on the same layout as the foundation bolts (also not shown). By using the sill anchor(s), and the exterior/interior partition corner stud lock (FIGS. 17–20) the wall is not only framed, but the exterior siding may be installed, the insulation put in the wall, together with the rough plumbing, electrical wiring, convenience outlets,—in short, everything to be installed in the wall is placed in the wall, the interior finish (sheetrock or paneling) is installed, leaving only the interior trim (molding) and the exterior corner trim to be installed in the field at the construction site.

FIG. 10 also shows the arc-shaped metal anchor D to be embedded in concrete. This arc-shaped metal anchor has a rectangular shank G at one end and is to be spot welded at the point represented by H. Additionally, FIG. 13 shows the tang 1 (or projecting shank, tongue or fang) that is notched out.

Figure 14:
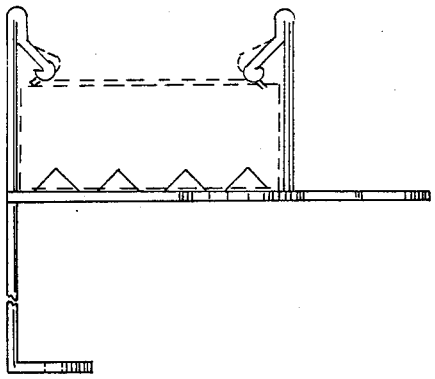
FIG. 14 is a front elevational view of the subfloor sill anchor of the present invention for use with the exterior wall.
Figure 15:
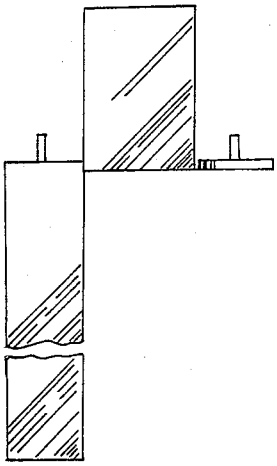
FIG. 15 is a side elevational view of the same lock for use with the interior wall.
Figure 16:
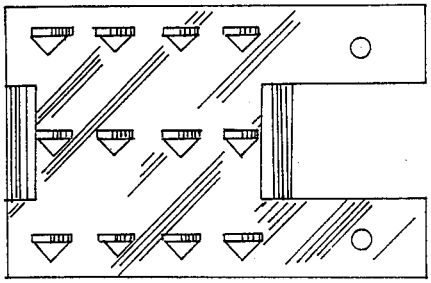
FIG. 16 is a top plan view of the same lock for use with the exterior wall.
Figure 17:
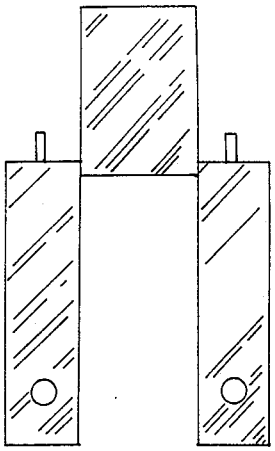
FIG. 17 is a side elevational view of the exterior/interior partitions corner stud lock of the present invention.
Figure 18:
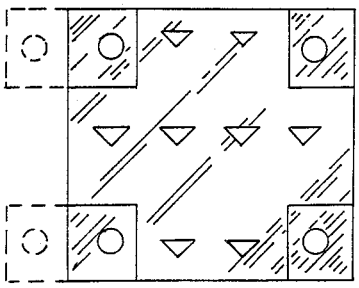
FIG. 18 is a bottom view of the same lock.
Figure 19:
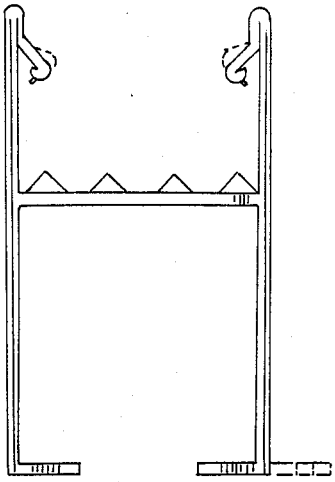
FIG. 19 is a front elevational view of the same lock.
Figure 20:
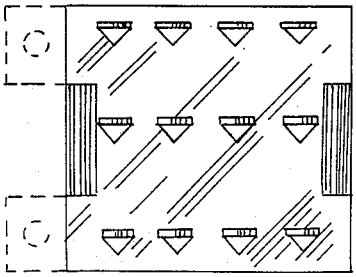
FIG. 20 is a top plan view of the same lock.
Figure 21:
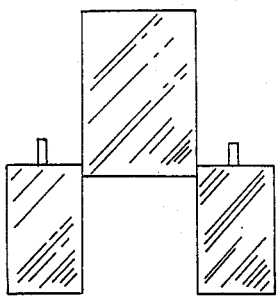
FIG. 21 is a side elevational view of the stud lock of the present invention.
Figure 22:
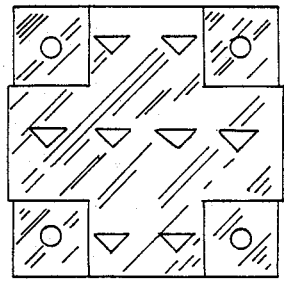
FIG. 22 is a bottom view of the same lock.
Figure 23:
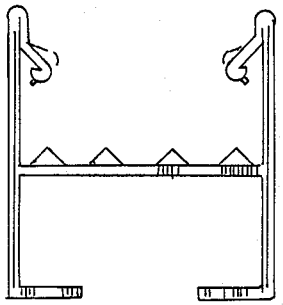
FIG. 23 is a front elevational view of the same lock.
Figure 24:
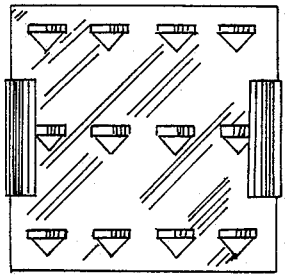
FIG. 24 is a plan view of the same lock.
Figure 25:
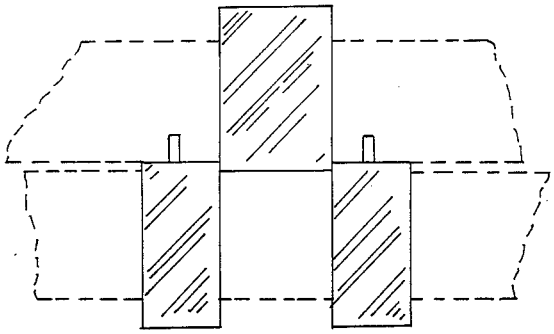
FIG. 25 is a side elevational view of the top plate lock of the present invention.
Figure 26:
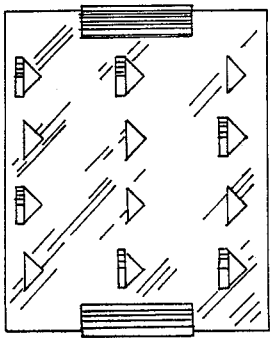
FIG. 26 is a plan view of the same lock.

The subfloor sill anchor of FIGS. 14–16 is used with either interior or exterior walls when a joist system is used, or either a single or double joist system is being used under the partition wall. The subfloor sill anchor is also used as a subfloor sill anchor corner retainer for the exterior wall.

In order to lock the inner partition wall corners together, or to lock interior and exterior corners together and to lock the inner partition wall to the exterior wall, there is shown in the differing views of FIGS. 17–20, the exterior/interior partition corner stud lock.

In order to lock two studs together, when extending a wall, in the event the wall is to be built in a shorter module than its overall length, the stud lock shown in the differing views of FIGS. 21–24 is demonstrated.

In order to connect the two top plates and truss together at the UBC intervals and at plate butt joints, or a top plate to a wall plate, a top plate lock shown in the differing embodiments of FIGS. 25–28 may be used as needed in the plurality necessary and may be attached to the top plate, or stud plate (which should be attached to the roof truss system), paying particular attention to the joist(s) or truss(es) and the stud layouts so as not to interfere with each other.

Figure 29:
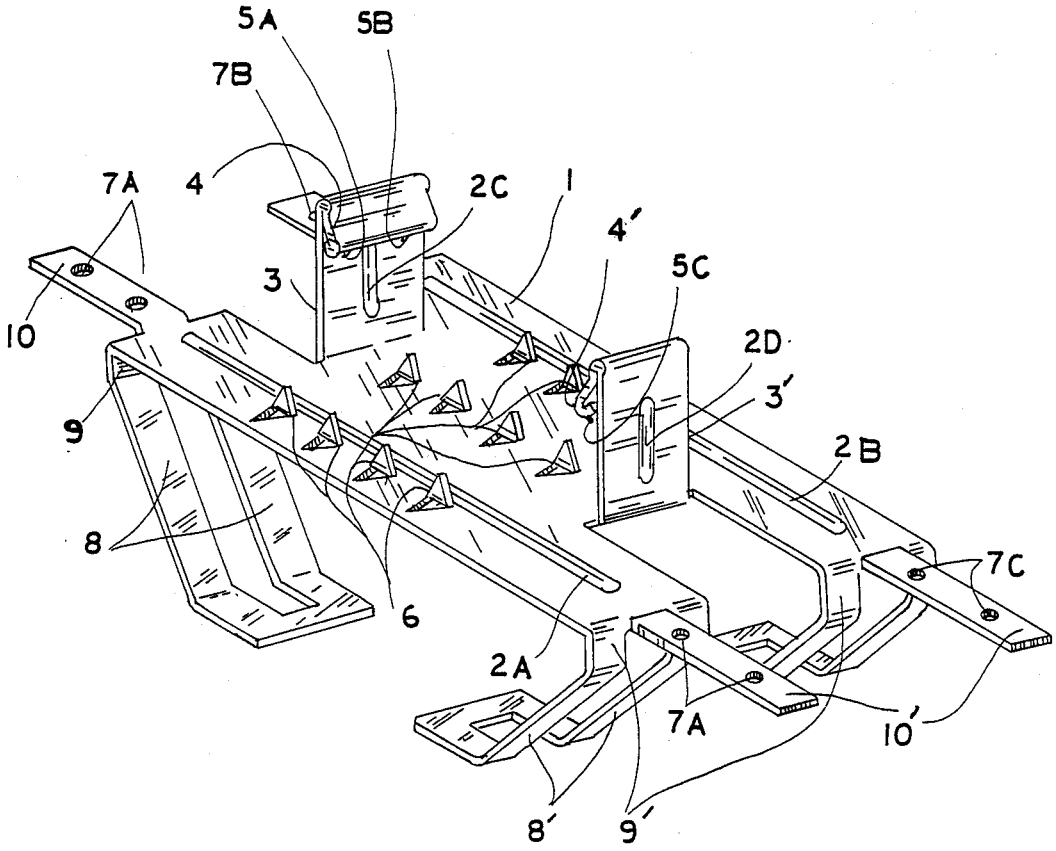
FIG. 29 is an oblique elevational view of the mudsill anchor and wall spreader of the present invention.

FIG. 29 is a view of the mudsill anchor and wall spreader containing the base plate 1. There are formed reinforcement indentations *2a, 2b, 2c* and *2d* in the material for strengthening purposes. Bases 3 and 3' are formed for finger clip retainers 4 and 4'. These finger clip retainers serve to hold the construction material in place. Extrusions *5a, 5b* and *5c* act as additional grippers to hold this construction material in place. Extrusions 6 in the base plate 1 prevent horizontal shifting of the construction material. For additional anchoring of this particular blind lock to a form (not shown) are nail holes *7a, 7b, 7c* and *7d*. To act as anchors, embedded in the concrete are legs 8 and 8'. In order to keep the forms spread, form wall retainers 9 and 9' are shown, while elevation tabes 10 and 10' are used to maintain elevation while pouring the concrete, are formed up a metal thickness and then out, and are to be broken off upon removal of the forms. Also included in this mudsill anchor and wall spreader fabrication of the blind lock are items not shown, such as cutouts for the concrete to pour through for additional concrete embedment and perforations to serve as break points—four places—upon removal of the forms, and are to be broken off at that time, for a flush finish.

Figure 30:
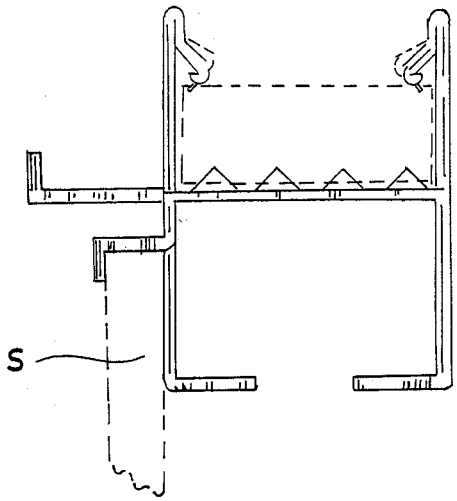
FIG. 30 is an end view of the continuous lock with sheetrock return of the present invention.

In FIG. 30 is shown the continuous lock with sheetrock return of the metal blind lock showing sheetrock material S to be nailed 16 inches on centerline, that is, two nails 1 inch apart. By providing this tab as shown, nailing of the edges and ends at all intersecting corners is eliminated. This particular lock may be used as a top plate lock or for a corner stud lock.

While I have illustrated and described the preferred form of construction for carrying the present invention into effect, this is capable of variation and modification without departing from the spirit of the invention. It therefore is to be understood that the invention is not limited to the precise details of construction as set forth, but other modifications as will be apparent to practitioners in the art may be resorted to within the scope of the appended claims.

I claim:

1. A building structure construction device comprising a blind lock of the character disclosed, wherein:

said blind lock is of unitary construction for securely binding together pairs of suitable similar and/or dissimilar construction materials of similar and/or dissimilar thicknesses;

said blind lock is configured into a substantially rectangular shape to fit snugly around pairs of suitable similar and/or dissimilar construction materials of similar and/or dissimilar thicknesses; and further characterized by being constructed with a plurality of legs disposed in a plane substantially parallel to each other;

with the top end parts of said legs shaped into angles that form downwardly inward resilient protrusions to grip the pairs of suitable similar and/or dissimilar construction materials of similar and/or dissimilar thicknesses;

said construction material gripped by said protrusions being completely beneath said protrusions;

with the bottom end parts of said legs shaped into angles that form inward or outward protrusions to hold the pairs of suitable similar and/or dissimilar construction materials of similar and/or dissimilar thicknesses and to anchor said blind lock;

with an interfitting center plate substantially of rectangular shape and disposed perpendicular to said legs; and additionally configured with multi plate-stamped cleats of isosceles triangular shape on said interfitting center plate.

2. The building structure construction device of claim 1 wherein:

said blind lock is fabricated into an inner partition lock.

3. The building structure construction device of claim 1 wherein:

said blind lock is fabricated into a concrete sill anchor.

4. The building structure construction device of claim 1 wherein:

said blind lock is fabricated into a concrete sill anchor corner retainer and additionally fabricated with an arc-shaped anchor having a projecting shank thereon.

5. The building structure construction device of claim 1 wherein:

said blind lock is fabricated into a subfloor sill anchor having only one pair of bottom legs included in said plurality of legs.

6. The building structure construction device of claim 1 wherein:

said blind lock is fabricated into an exterior/interior partition corner stud lock.

7. The building structure construction device of claim 1 wherein:

said blind lock is fabricated into a stud lock.

8. The building structure construction device of claim 1 wherein:

said blind lock is fabricated into a top plate lock and additionally fabricated with the bottom end parts of the legs being identical to said top end parts of the legs.

9. The building structure construction device of claim 1 wherein:

said blind lock is fabricated into a mudsill anchor and wall spreader having the anchoring ends of one pair of said plurality of legs offset.

10. The building structure construction device of claim 1 wherein:

said blind lock is fabricated into a continuous lock with wallboard return.

11. The method of building structure construction utilizing the device of claim 1 wherein:

said blind lock is fabricated into a concrete sill anchor.

12. The method of building construction utilizing the device of claim 1 comprising the steps of:

fabricating the blind lock into a concrete sill anchor retainer, and additionally fabricating the blind lock with an arc-shaped anchor having a projecting shank thereon.

13. The method of building structure construction incorporating the device of claim 1 comprising the step of:

fabricating the blind lock into a subfloor sill anchor, characterized as having only one pair of bottom legs included in said plurality of legs.

14. The method of building structure construction utilizing the device of claim 1 comprising the step of:

fabricating the blind lock into a mudsill anchor and wall spreader by bending and anchoring the ends of one pair of said plurality of legs.

* * * * *